US011818541B2

(12) United States Patent
Loeppert

(10) Patent No.: US 11,818,541 B2
(45) Date of Patent: Nov. 14, 2023

(54) MEMS STRUCTURE WITH STIFFENING MEMBER

(71) Applicant: Knowles Electronics, LLC, Itasca, IL (US)

(72) Inventor: Peter V. Loeppert, Durand, IL (US)

(73) Assignee: KNOWLES ELECTRONICS, LLC, Itasca, IL (US)

( * ) Notice: Subject to any disclaimer, the term of this patent is extended or adjusted under 35 U.S.C. 154(b) by 0 days.

(21) Appl. No.: 17/311,647

(22) PCT Filed: Dec. 23, 2019

(86) PCT No.: PCT/US2019/068415

§ 371 (c)(1),
(2) Date: Jun. 7, 2021

(87) PCT Pub. No.: WO2020/139860

PCT Pub. Date: Jul. 2, 2020

(65) Prior Publication Data

US 2022/0417670 A1 Dec. 29, 2022

Related U.S. Application Data

(60) Provisional application No. 62/786,104, filed on Dec. 28, 2018.

(51) Int. Cl.
*H04R 19/04* (2006.01)
*H04R 1/02* (2006.01)

(52) U.S. Cl.
CPC ..... *H04R 19/04* (2013.01); *H04R 1/02* (2013.01); *H04R 2201/003* (2013.01)

(58) Field of Classification Search
CPC .... H04R 19/04; H04R 1/02; H04R 2201/003; B81B 2203/019; B81B 2203/0145
See application file for complete search history.

(56) References Cited

U.S. PATENT DOCUMENTS

2009/0185700 A1 7/2009 Suzuki
2010/0278372 A1* 11/2010 Zhang ..... H04R 19/005 381/412
2014/0210020 A1* 7/2014 Dehe ..... B81C 1/00269 257/416
2021/0185448 A1* 6/2021 Kim ..... H04R 31/00

FOREIGN PATENT DOCUMENTS

EP 3247134 A1 11/2017

OTHER PUBLICATIONS

PCT Written Opinion of the International Searching Authority, PCT/US2019/068415, International Filing date Dec. 23, 2019, dated Jul. 2, 2020.
PCT International Search Report, International application No. PCT/US2019/068415, International filing date Dec. 23, 2019, dated of the international search Apr. 8, 2020.

* cited by examiner

*Primary Examiner* — Sean H Nguyen
(74) *Attorney, Agent, or Firm* — FLENER IP & BUSINESS LAW; Zareefa B. Flener

(57) ABSTRACT

A microelectromechanical system (MEMS) transducer includes a transducer substrate, a diaphragm, and a stiffening member. A first side of the diaphragm is coupled to the transducer substrate. A second side of the diaphragm is coupled to the stiffening member. The stiffening member includes a plurality of fingers extending inwards from a perimeter of an aperture defined by the transducer substrate.

28 Claims, 11 Drawing Sheets

MEMS STRUCTURE WITH STIFFENING MEMBER

CROSS-REFERENCE TO RELATED PATENT APPLICATIONS

The present application claims the benefit of and priority to U.S. Provisional Application No. 62/786,104, filed Dec. 28, 2018, entitled "MEMS Structure with Stiffening Member," the disclosure of which is incorporated herein by reference in its entirety.

BACKGROUND

The present disclosure relates generally to microelectromechanical system (MEMS) structures, particularly MEMS acoustic transducers. MEMS capacitive acoustic transducers include a stationary perforated back plate and a movable diaphragm, the diaphragm moving relative to the back plate in response to incident sound energy to generate an electrical signal. The electrical signal corresponds to a change in electrical capacitance between the diaphragm and the back plate. MEMS structures are often subjected to large loads when dropped or, additionally in the case of microphones and pressure sensors, large over-pressure conditions. These events can cause the structures to break near anchoring points, which can impact the functionality of the devices.

MEMS structures including both sensors and actuators generally include elements such as beams or membranes attached to a substrate and extending over a recessed region. At the point of attachment, there is stress concentration resulting from the abrupt change in stiffness, which may cause fracture when the structure is overloaded. A conventional approach to mitigate the stress concentration is to include a fillet at the attachment point. However, as the stiffness of a member increases with the third power of thickness, fillets are a less than ideal way to reduce stress concentration.

SUMMARY

A first aspect of the present disclosure relates to a MEMS transducer. The MEMS transducer includes a transducer substrate defining an aperture. The transducer also includes a diaphragm having a first side and a second side. The first side of the diaphragm is coupled to the transducer substrate and is disposed over the aperture. The transducer further includes a stiffening member coupled to the second side of the diaphragm. The stiffening member includes a plurality of fingers extending inwards from a perimeter of the aperture.

A second aspect of the present disclosure relates to a microphone assembly. The microphone assembly includes a housing including a base, a cover, and a port. The microphone includes an acoustic transducer disposed in an enclosed volume defined by the housing. The acoustic transducer includes a transducer substrate including an aperture, a diaphragm, and a stiffening member. A first side of the diaphragm is coupled to the transducer substrate. The diaphragm is in fluid communication with the port. The stiffening member is coupled to the second side of the diaphragm. The stiffening member includes a plurality of fingers extending inwards from a perimeter of the aperture.

A third aspect of the present disclosure relates to a MEMS acoustic transducer. The MEMS acoustic transducer includes a transducer substrate, a diaphragm, a back plate, and a stiffening member. The diaphragm includes a first side and a second side. The first side of the diaphragm is coupled to the transducer substrate and is disposed over an aperture defined by the transducer substrate. The back plate defines a plurality of openings. The back plate is attached to the substrate and is oriented substantially parallel to the diaphragm. The back plate is offset from the diaphragm such that a cavity is formed between the back plate and the diaphragm. The stiffening member is coupled to the second side of the diaphragm. The stiffening member includes a plurality of fingers extending inwards from a perimeter of the aperture.

The foregoing summary is illustrative only and is not intended to be in any way limiting. In addition to the illustrative aspects, embodiments, and features described above, further aspects, embodiments, and features will become apparent by reference to the following drawings and the detailed description.

BRIEF DESCRIPTION OF THE DRAWINGS

The foregoing and other features of the present disclosure will become more fully apparent from the following description and appended claims, taken in conjunction with the accompanying drawings. These drawings depict only several embodiments in accordance with the disclosure and are, therefore, not to be considered limiting of its scope. Various embodiments are described in more detail below in connection with the appended drawings.

Figure 1:
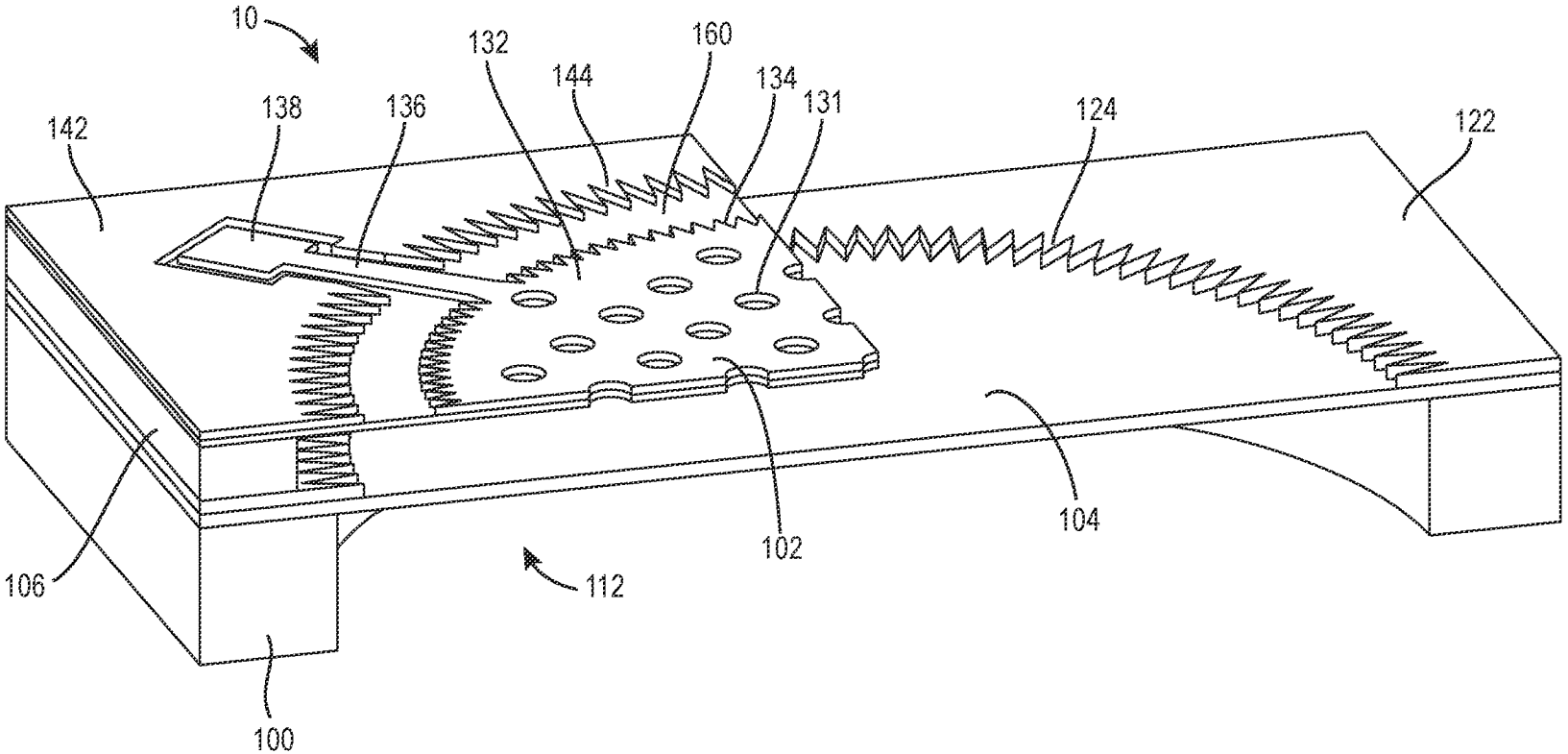
FIG. 1 is a perspective cross-sectional view of a MEMS transducer, according to an illustrative embodiment.

In the following detailed description, various embodiments are described with reference to the appended drawings. The skilled person will understand that the accompanying drawings are schematic and simplified for clarity and therefore merely show details which are essential to the understanding of the disclosure, while other details have been left out. Like reference numerals refer to like elements or components throughout. Like elements or components will therefore not necessarily be described in detail with respect to each figure.

DETAILED DESCRIPTION

The present disclosure presents a stiffness member that serves to smooth the stiffness transition from the cantilever region of a MEMS structure to an anchored region of the MEMS structure and thus reduce the maximum stress value for a given loading. It will be appreciated by those skilled in the art that although the stiffness member is presented in the context of a MEMS microphone, the stiffness member may be applied to any MEMS structure where there is an abrupt stiffness change in order to improve the robustness of the structure.

In general, disclosed herein are devices and systems for strengthening structures such as diaphragms, back plates, and beams used for MEMS transducers. The devices include a stiffening member including a plurality of fingers disposed adjacent to an anchoring region or perimeter of the structural element. The fingers may, advantageously, increase the over-pressure and loading tolerance of the MEMS structure, particularly when compared to fillets and other supporting features.

In one aspect, the MEMS transducer includes a transducer substrate, a diaphragm, and a stiffening member. A first side of the diaphragm is coupled to (e.g., anchored to, connected to, deposited onto, etc.) the substrate and cantilevered over an aperture defined by the transducer substrate. A second side of the diaphragm, proximate to a perimeter of the aperture, is coupled to the stiffening member. The stiffening member includes a plurality of fingers that extend inwards from the perimeter of the aperture. The fingers support the diaphragm and reduce the stress associated with the abrupt change in cross-sectional area where the diaphragm meets with the substrate (e.g., at the anchoring region proximate to the perimeter of the aperture). The stiffening member may be formed from the same material as the diaphragm to reduce cost. In some embodiments, the fingers are triangular.

In embodiments where the diaphragm is made from a dielectric material (e.g., silicon nitride, etc.), the transducer may further include a second stiffening member coupled to the second side of the diaphragm. The second stiffening member may be made from a conductive material configured to form an electrode as one half of a capacitive sensor, the other half being formed by a stationary back plate or another conductive member. The second stiffening member, being placed generally in the center region of the diaphragm, may include a second plurality of fingers extending outward toward the perimeter of the aperture (e.g., toward the first plurality of fingers, away from a central region of the diaphragm, etc.). The second plurality of fingers is configured to reduce stress in the diaphragm along an outer perimeter of the second stiffening member.

The stiffening members are configured to reduce stress in the diaphragm near anchoring points for the diaphragm and/or near where the diaphragm has a stiffness change due to a thickness change, for instance at an electrode boundary. In general, the technique of adding stiffness members is useful for any structure that has a region of stress concentration caused by an abrupt change in stiffness. By reducing the maximum stress in the diaphragm, the stiffening members can, advantageously, increase the pressures and loads that can be tolerated by the MEMS transducer. The details of the general depiction provided above will be more fully explained by reference to FIGS. 1-18.

FIG. 1 shows a MEMS transducer, shown as transducer 10, according to an illustrative embodiment. In the embodiment of FIG. 1, the transducer 10 is configured as a capacitive acoustic transducer configured to generate an electrical signal in response to acoustic disturbances incident on the transducer 10. The transducer 10 includes a transducer substrate 100, a back plate 102, and a diaphragm 104. As shown in FIG. 1, the transducer substrate 100 is generally rectangular and typically made of silicon although other materials are contemplated. The transducer substrate 100 includes a recessed region. In the embodiment of FIG. 1, the recessed region is a substantially cylindrical aperture 112, disposed centrally through the substrate 100. The aperture 112 is configured to carry (e.g., transmit, etc.) sound energy to at least one of the diaphragm 104 and the back plate 102.

In the embodiment of FIG. 1, the diaphragm 104 is made of a conductive material, such as polysilicon, and is attached to the substrate 100 and disposed over the aperture 112. The diaphragm 104 is configured to vibrate in response to acoustic pressure. The back plate 102 is attached to the substrate 100 with an intervening sacrificial layer 106 to space it from the diaphragm 104. The back plate 102 is comprised of a dielectric material 160, such as silicon nitride. The central region of the back plate 102 includes a conductive electrode 132. Electrical access to the conductive electrode 132 is provided by pad 138 and lead 136. A plurality of perforations 131 in the back plate 102 allow air, otherwise trapped between the diaphragm 104 and the back plate 102, to escape. The back plate 102 is stiff and thus relatively stationary compared to the diaphragm. The stiffness of the back plate 102 results from tension on the back plate and the thickness of the back plate.

As compared to a simple cantilevered back plate and diaphragm, the diaphragm 104 and the back plate 102 of FIG. 1 are less likely to be damaged when the transducer 10 is subjected to very high overload pressures or shock. Diaphragm 104 is strengthened against overload with the inclusion of a stiffening member 122, attached to the diaphragm 104 and disposed outside the perimeter of the aperture 112. The stiffening member has a plurality of fingers 124 extending from the perimeter of the aperture 112 inwards towards the center of the diaphragm 104. The fingers 124 serve to reduce the stress concentration that otherwise occurs at the attachment point (e.g., the abrupt stiffness change) where the diaphragm 104 is anchored to the substrate 100. The stiffening member 122 and the fingers 124 can be made of any of several materials such as polysilicon or silicon nitride. In the embodiment of FIG. 1, the stiffening member 122 and fingers 124 are made of polysilicon.

The back plate 102 is strengthened against overload by the inclusion of stiffening member 142 attached to the back plate 102 and positioned on an opposite side of the back plate 102 as the substrate 100. The stiffening member 142 includes fingers 144 extending from the perimeter of the attachment region inwards towards the center of the back plate 102. Stiffening member 142 and fingers 144 can be made of any of several materials such as polysilicon or silicon nitride. In the embodiment of FIG. 1, the stiffening member 142 and fingers 144 are formed in the same step as the central conductive electrode 132 and thus are made of polysilicon. The formation of a conductive electrode 132 on the dielectric material 160 creates a step change in thickness that gives rise to a stress concentration at the edge of the conductive electrode 132. The fingers 134 formed at the edge of the conductive electrode mitigate this stress concentration. Fingers 134 may be formed at the same time as the conductive electrode 132 and thus can be made of the same material (e.g., polysilicon).

Figure 2:
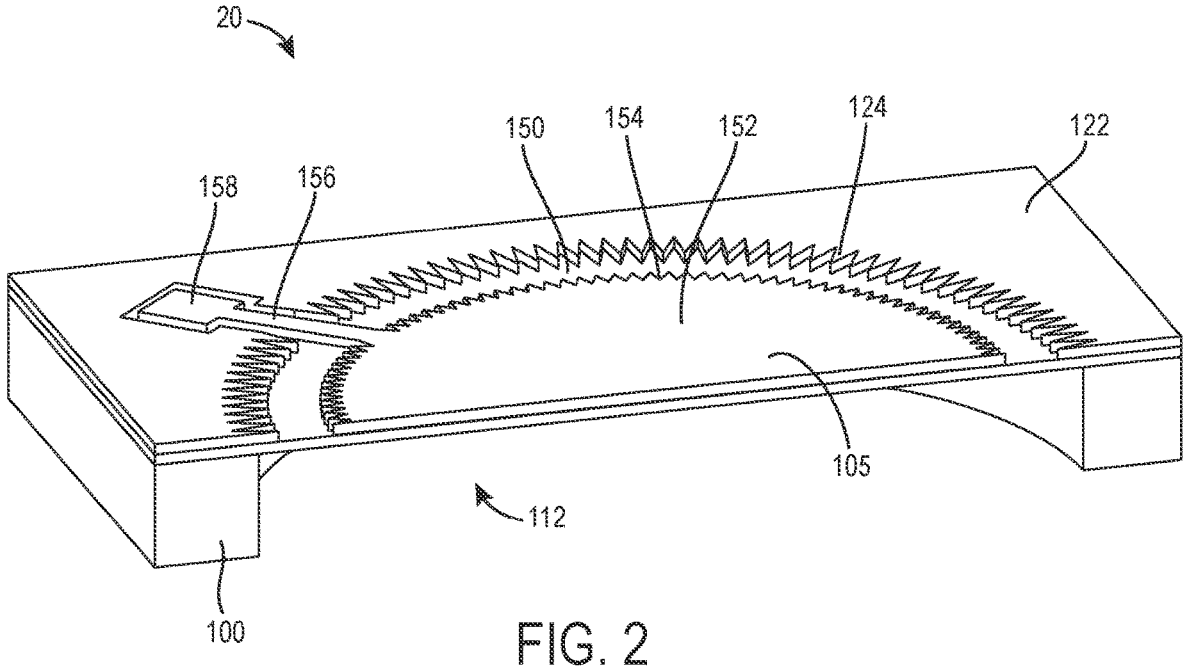
FIG. 2 is a perspective cross-sectional view of an alternate diaphragm that can be used with the MEMS transducer of FIG. 1.

An alternate embodiment of transducer 20 is depicted in FIG. 2. The sacrificial material 106 and back plate 102 have been removed to provide clarity. The diaphragm 105 of FIG. 2 is composed of a dielectric material 150 such as silicon nitride. The diaphragm 105 is attached to the substrate 100 and disposed over the aperture 112. A central conductive electrode 152 is formed on top of the dielectric material 150 to act as one half of the capacitive transducer 10. The other half is provided by the back plate 102, not shown. Electrical access to the conductive electrode 152 is provided by pad 158 and lead 156. Stress concentration occurs at both the attachment point of the diaphragm 105 to the substrate 100 and at the perimeter of the conductive electrode 152 where a thickness step change occurs. The diaphragm 105 is strengthened against overload with the inclusion of a stiffening member 122 and fingers 124 as described with respect to FIG. 1. In addition, the diaphragm 105 is strengthened against overload by the inclusion of fingers 154 extending radially outward from the edge of the conductive electrode 152.

Figure 3:
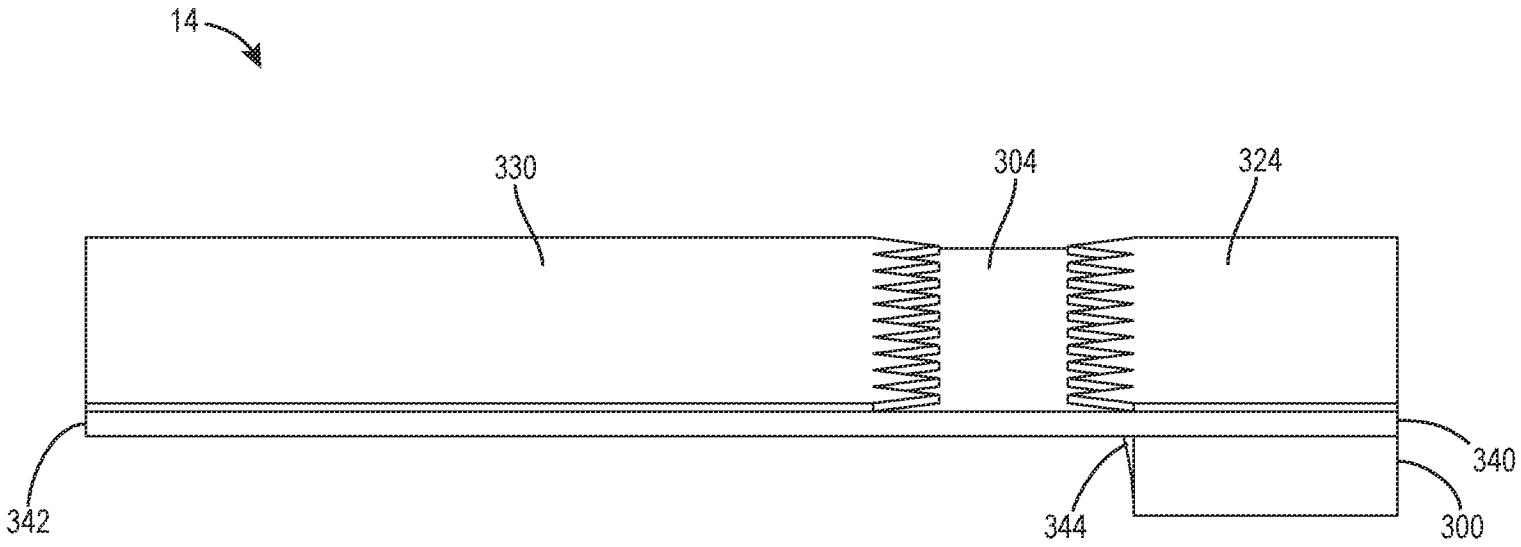
FIG. 3 is a perspective view of a beam-type MEMS structure, according to an illustrative embodiment.

In another example, FIG. 3 provides a MEMS structure 14 that is configured as a cantilevered beam, according to an illustrative embodiment. The structure 14 may be configured as a microcantilever (e.g., a MEMS-based sensor, switch, actuator, resonator, probe, etc. configured such that the tip of the cantilever moves in response to a load or stimulus). As shown in FIG. 3, the structure 14 includes a thin rectangular beam 304, a first stiffening member 324 and a second stiffening member 330. A first end 340 of the rectangular beam 304 is attached to a substrate 300. A second end 342 of the beam 304 is cantilevered such that it extends beyond a side wall 344 of the substrate 300. In some implementations, the second end 342 of the beam 304 is cantilevered over a recessed region defined at least partially by the substrate 300.

Figure 4:
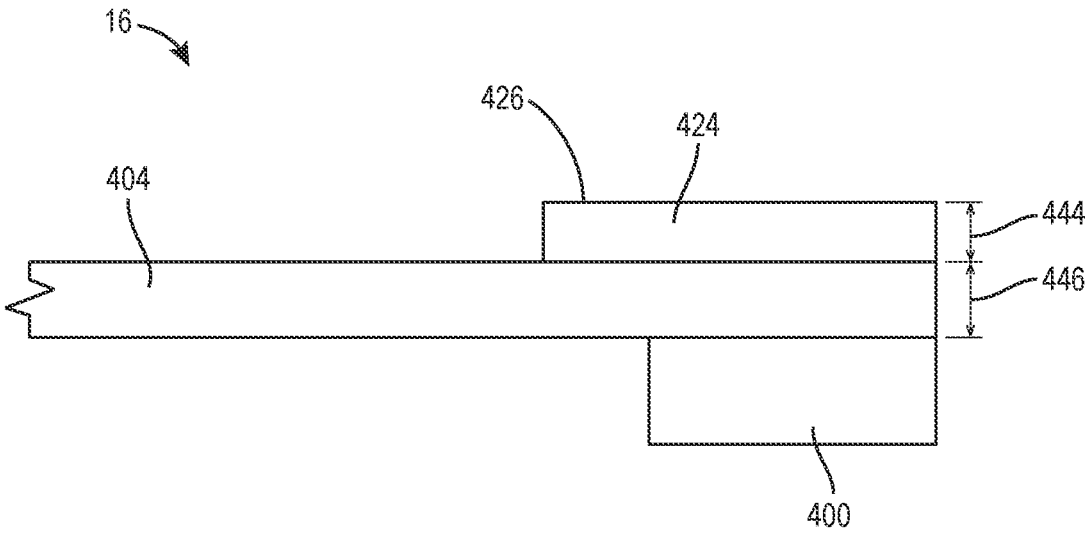
FIG. 4 is a side view of a beam-type MEMS structure, according to another illustrative embodiment.
Figure 5:
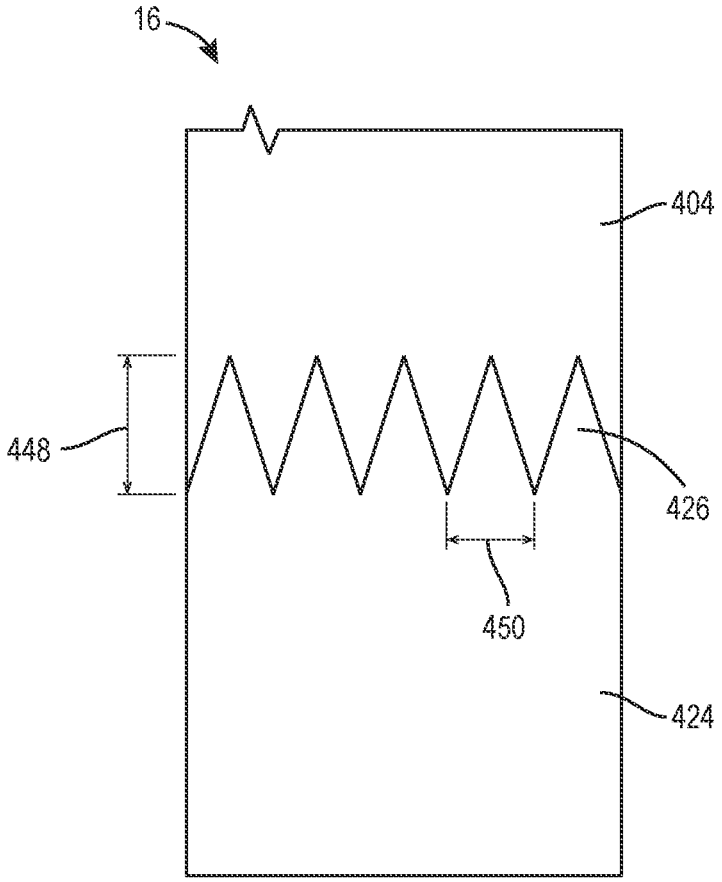
FIG. 5 is a top view of the MEMS structure of FIG. 4.

The size and shape of the stiffening members and fingers may be different in various alternative embodiments. Referring to FIGS. 4-5, a MEMS structure 16 is provided, according to another illustrative embodiment. The structure 16 may be substantially similar to the structure 14 described with reference to FIG. 3. As shown in FIGS. 4-5, the structure 16 includes a substrate 400, a beam 404, and a first stiffening member 424. The first stiffening member 424 includes a first plurality of fingers 426. In the embodiment of FIG. 4, the first stiffening member 424 is of uniform thickness 444.

As shown in FIG. 4, the thickness 444 of the first stiffening member 424 is approximately equal to a thickness 446 of the beam 404. According to an illustrative embodiment, the thickness 444 of the first stiffening member 424 is within a range between approximately 50% and 200% of the thickness 446 of the beam 404, although values outside of this range may also provide structural benefits.

As shown in FIG. 5, each one of the first plurality of fingers 426 is triangular. A length 448 of each finger 426, from a root of the finger 426 to a tip of the finger 426 (e.g., a length of each finger from a side wall or perimeter of the substrate 400), is greater than the thickness 444 of the first stiffening member 424 and, correspondingly, the thickness 446 of the beam 404. The length 448 of the fingers 426 is a design variable that determines how the stiffness increases from that of the beam alone to that of the anchor region. A triangular shape causes the stiffness to vary linearly along the finger length.

According to an illustrative embodiment, a width 450 of each finger 426 in a direction substantially normal to the length (e.g., in a substantially circumferential direction along the perimeter of the aperture 112 of FIGS. 1-2, etc.) is within a range between approximately 25% and 100% of the length 448. In the embodiments of FIG. 5, the width 450 sets a number of fingers in contact with the beam 404.

Figure 6:
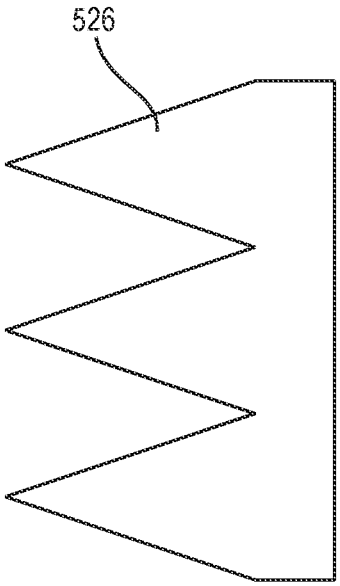
FIG. 6 is a top view of a stiffening member for a MEMS transducer, according to an illustrative embodiment.
Figure 7:
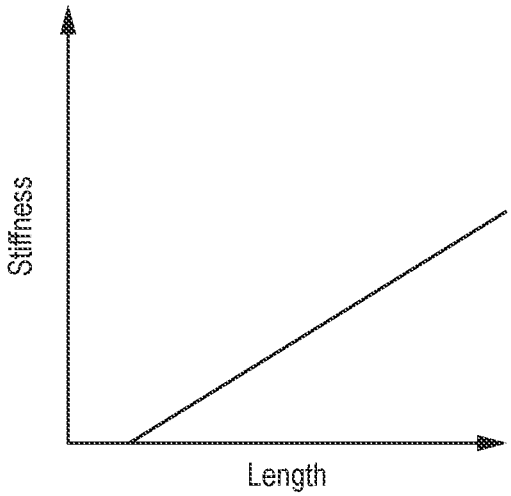
FIG. 7 is a graph showing stiffness as a function of position along the stiffening member of FIG. 6, according to an illustrative embodiment.

The configuration of fingers, in part, determines the distribution of stress near an anchoring point (e.g., near the perimeter of an aperture, near the root of the fingers, etc.) for the structure. Accordingly, the shape, size, and arrangement of fingers may be different in various alternative embodiments. FIG. 6 provides a plurality of triangular fingers 526, which are substantially similar to the fingers shown in FIGS. 1-5. FIG. 7 provides, approximately, a graph illustrating the variation in stiffness as a function of position along the length of the fingers 526 (e.g., the distribution of stiffness associated with a load applied normal to the fingers 526, into and out of the page as shown in FIG. 6). As shown in FIG. 7, the stiffness of the structure increases approximately linearly, in proportion to the width of the fingers 526, along the length of the fingers 526.

Figure 8:
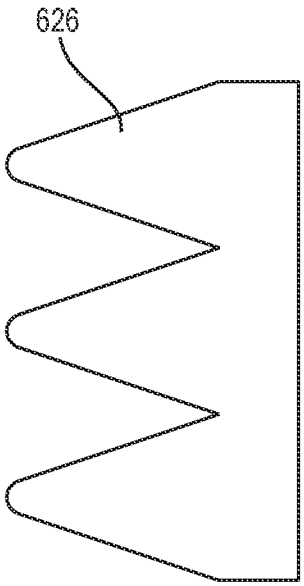
FIG. 8 is a top view of a stiffening member for a MEMS transducer, according to another illustrative embodiment.
Figure 9:
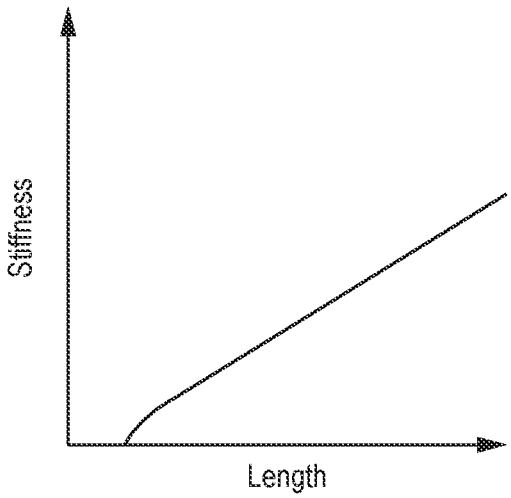
FIG. 9 is a graph showing stiffness as a function of position along the stiffening member of FIG. 8, according to an illustrative embodiment.

FIGS. 8-13 provide examples of fingers of different shapes, according to various alternative embodiments. In the embodiment of FIG. 8, the fingers 626 are triangular with rounded tips. As shown in FIG. 9, the rounded portion of each finger 626 results in a more abrupt increase of the stiffness near the tip of the fingers as compared with the sharp transition of the fingers 526 of FIGS. 6-7.

Figure 10:
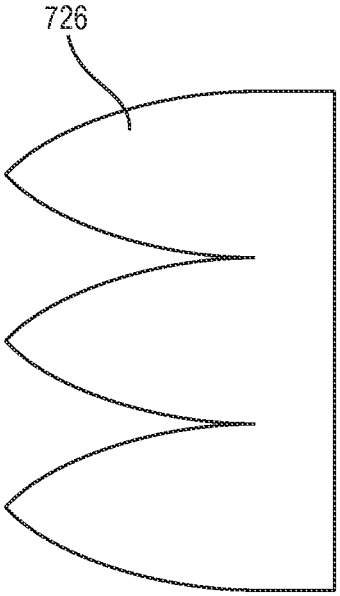
FIG. 10 is a top view of a stiffening member for a MEMS transducer, according to another illustrative embodiment.
Figure 11:
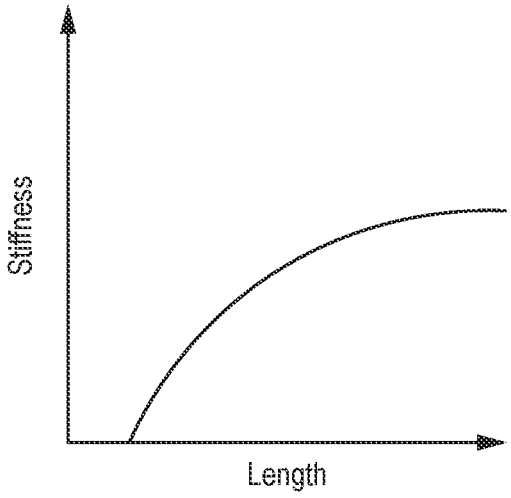
FIG. 11 is a graph showing stiffness as a function of position along the stiffening member of FIG. 10, according to an illustrative embodiment.
Figure 12:
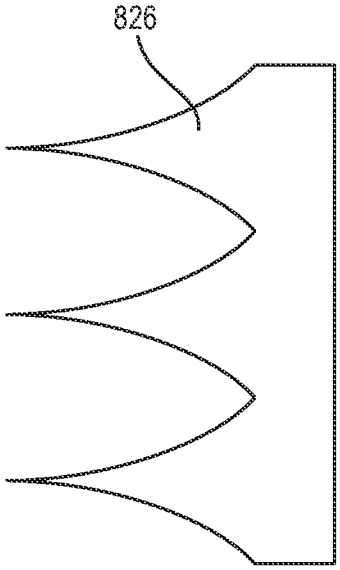
FIG. 12 is a top view of a stiffening member for a MEMS transducer, according to another illustrative embodiment.
Figure 13:
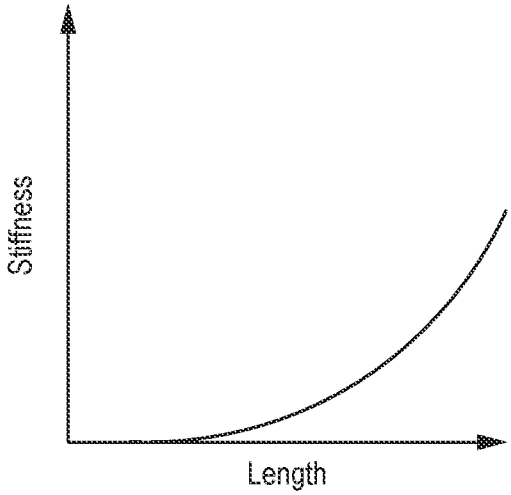
FIG. 13 is a graph showing stiffness as a function of position along the stiffening member of FIG. 12, according to an illustrative embodiment.

In the embodiment of FIG. 10, the fingers 726 are in a flower petal shape. The sides of each finger 726 are curved outwards so that the width of the fingers 726 increases rapidly near the tip of the fingers 726. As shown in FIG. 11, the fingers 726 of FIG. 10 result in a nearly logarithmic increase in stiffness from the tip to the root of the fingers 726. Conversely, in the embodiment of FIG. 12, the fingers 826 are in a gear shape (e.g., a shape of a bike gear). The sides of each finger 826 are curved inwards so that the width of the fingers 826 increases rapidly near the root of the fingers 826 and extends to a fine point at the tip. In other embodiments, the fingers 826 may be rounded at the tip or straight across at the tip. As shown in FIG. 13, the fingers 826 of FIG. 12 provide an approximately exponential increase in stiffness from the tip to the root of the fingers 826.

Figure 2A:
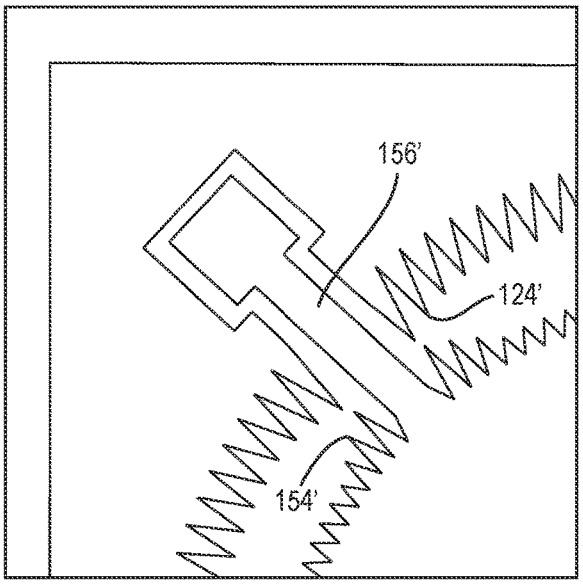
FIG. 2A is a top view of a diaphragm near an electrical lead, according to an illustrative embodiment.

In some embodiments, the size or shape of at least one finger may be different from the size of another finger. For example, the length of the fingers may vary in a repeating manner along the perimeter of the aperture or as needed to tailor the stiffness profile for a given application. In alternative embodiments, the shape of each finger may vary along the perimeter of the aperture. For instance, in FIG. 2 the fingers 124' and 154' near the electrical lead 156' may be longer to smooth the stiffness caused by the lead itself (see FIG. 2A).

Figure 14:
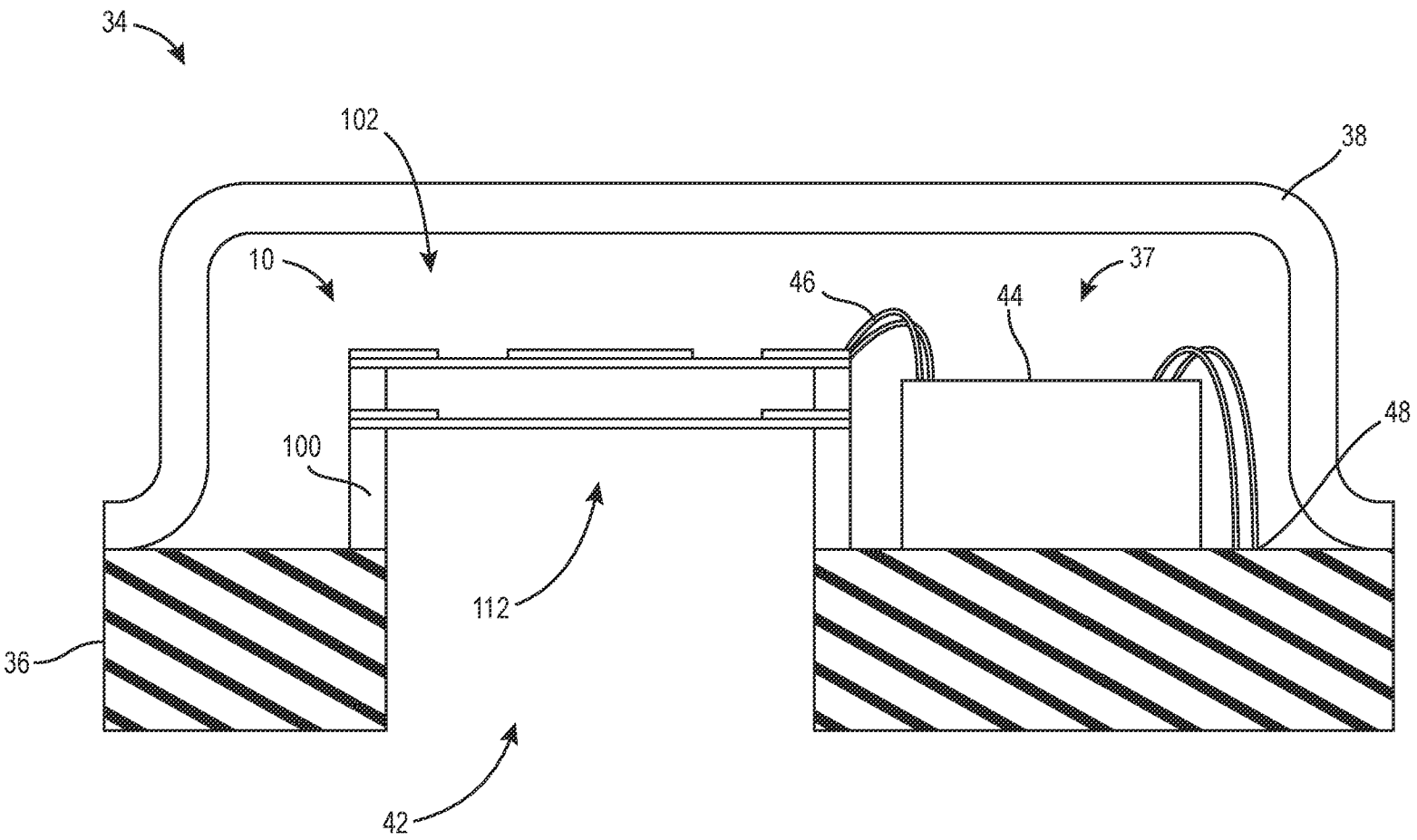
FIG. 14 is a side cross-sectional view of a microphone assembly, according to an illustrative embodiment.

According to an illustrative embodiment, as shown in FIG. 14, the MEMS transducer (e.g., the acoustic transducer 10 of FIGS. 1-2), is configured to be received within a microphone assembly 34. As shown in FIG. 14, the assembly 34 includes a housing including a microphone substrate 36, a cover 38 (e.g., a housing lid), and a sound port 42. The cover 38 may be coupled to the microphone substrate 36 (e.g., the cover 38 may be mounted onto a peripheral edge of the microphone substrate 36). Together, the cover 38 and the microphone substrate 36 may form an enclosed volume 37 for the assembly 34. The sound port 42 may also be disposed on the microphone substrate 36 and may be configured to convey sound waves to a transducer 10 located within the enclosed volume 37. Alternatively, the sound port 42 may be disposed on the cover 38 or on a side wall of the housing. As shown in FIG. 14, the aperture 112 is substantially aligned with the port 42. In other embodiments, the aperture 112 encompasses (e.g., surrounds, etc.) the port 42. In some embodiments, the assembly may form part of a compact computing device (e.g., a portable communication device, a smartphone, a smart speaker, an internet of things (IoT) device, etc.), where one, two, three or more assemblies may be integrated for picking-up and processing various types of acoustic signals such as speech and music.

As shown in FIG. 14, the assembly 34 additionally includes an electrical circuit disposed in the enclosed volume 37. The electrical circuit includes an integrated circuit (IC) 44. The IC 44 may be an application specific integrated circuit (ASIC). Alternatively, the IC 44 may include a semiconductor die integrating various analog, analog-to-digital, and/or digital circuits.

In the embodiment of FIG. 14, the transducer 10 is configured to generate an electrical signal (e.g., a voltage) at a transducer output in response to acoustic activity incident on the port 42. As shown in FIG. 14, the transducer output includes a pad or terminal of transducer 10 that is electrically connected to the electrical circuit via one or more bonding wires 46. The pad may be the same or substantially similar to the pad 158 described with reference to FIG. 2. The assembly 34 of FIG. 14 further includes electrical contacts, shown schematically as contacts 48 disposed on a surface of the microphone substrate 36. The contacts 48 may be electrically coupled to the electrical circuit and may be configured to electrically connect the microphone assembly 34 to one of a variety of host devices.

Figure 15:
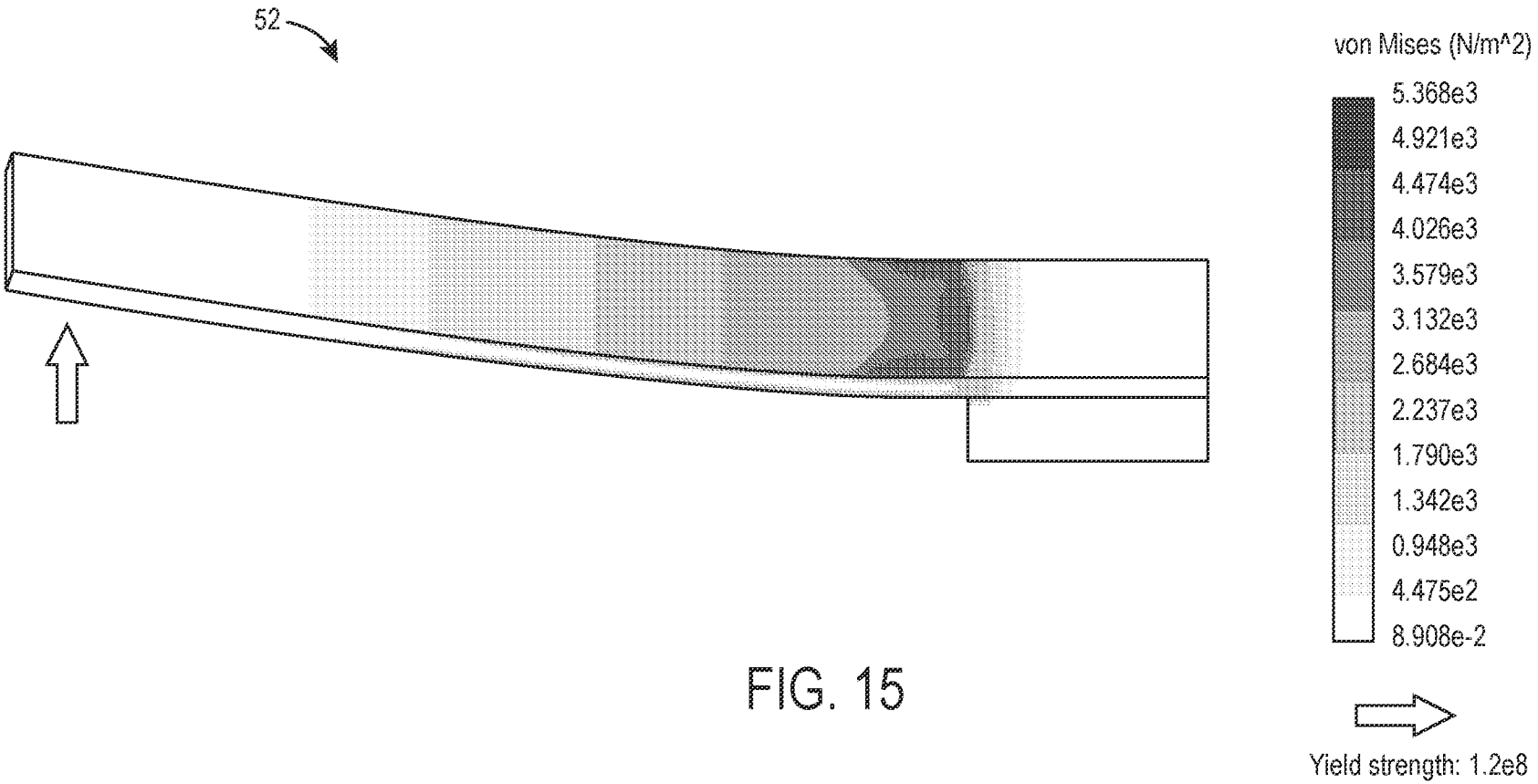
FIG. 15 is a contour plot showing the distribution of stress in a simple cantilevered beam, according to an illustrative embodiment.
Figure 16:
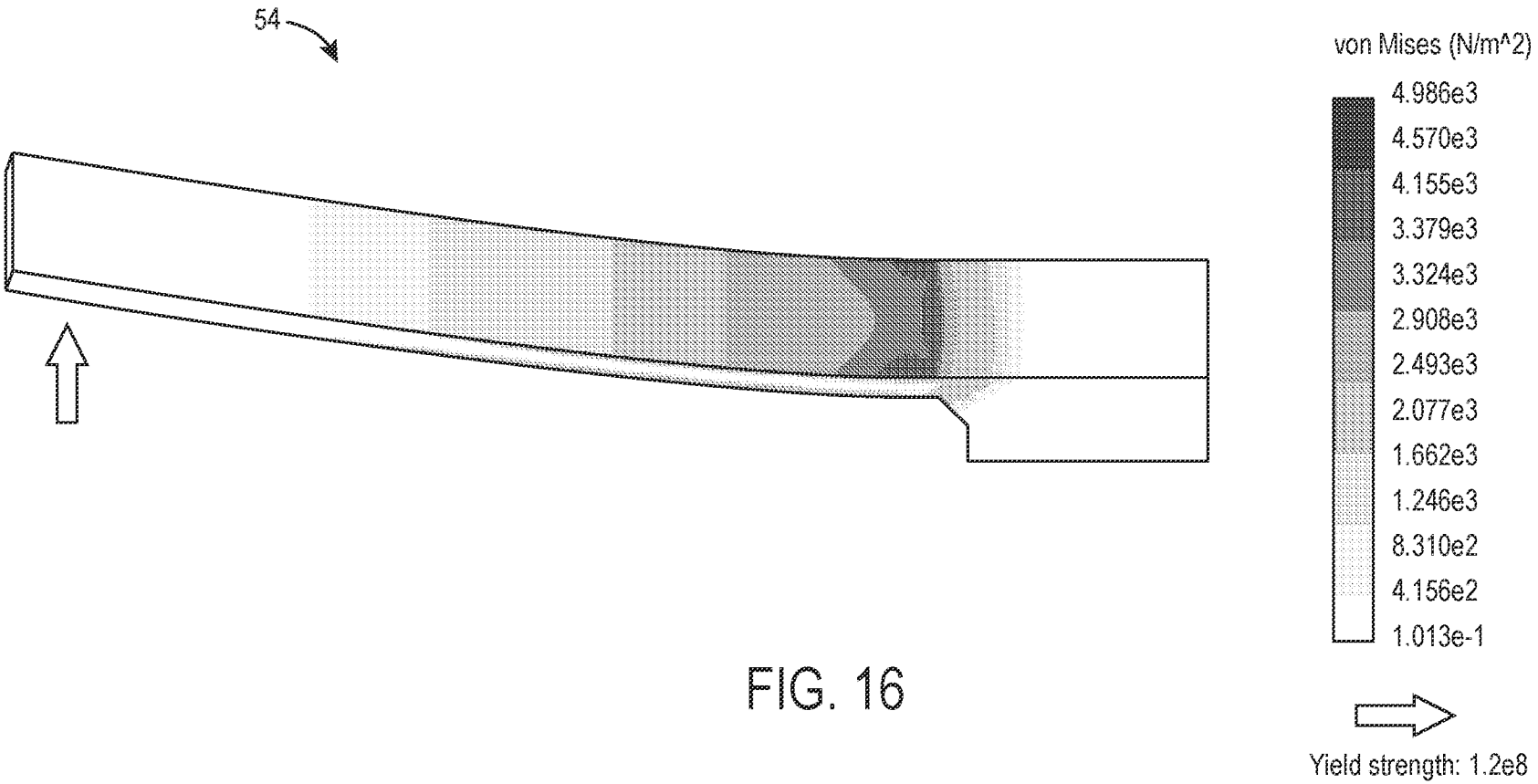
FIG. 16 is a contour plot showing the distribution of stress in a cantilevered beam supported by a fillet, according to an illustrative embodiment.
Figure 17:
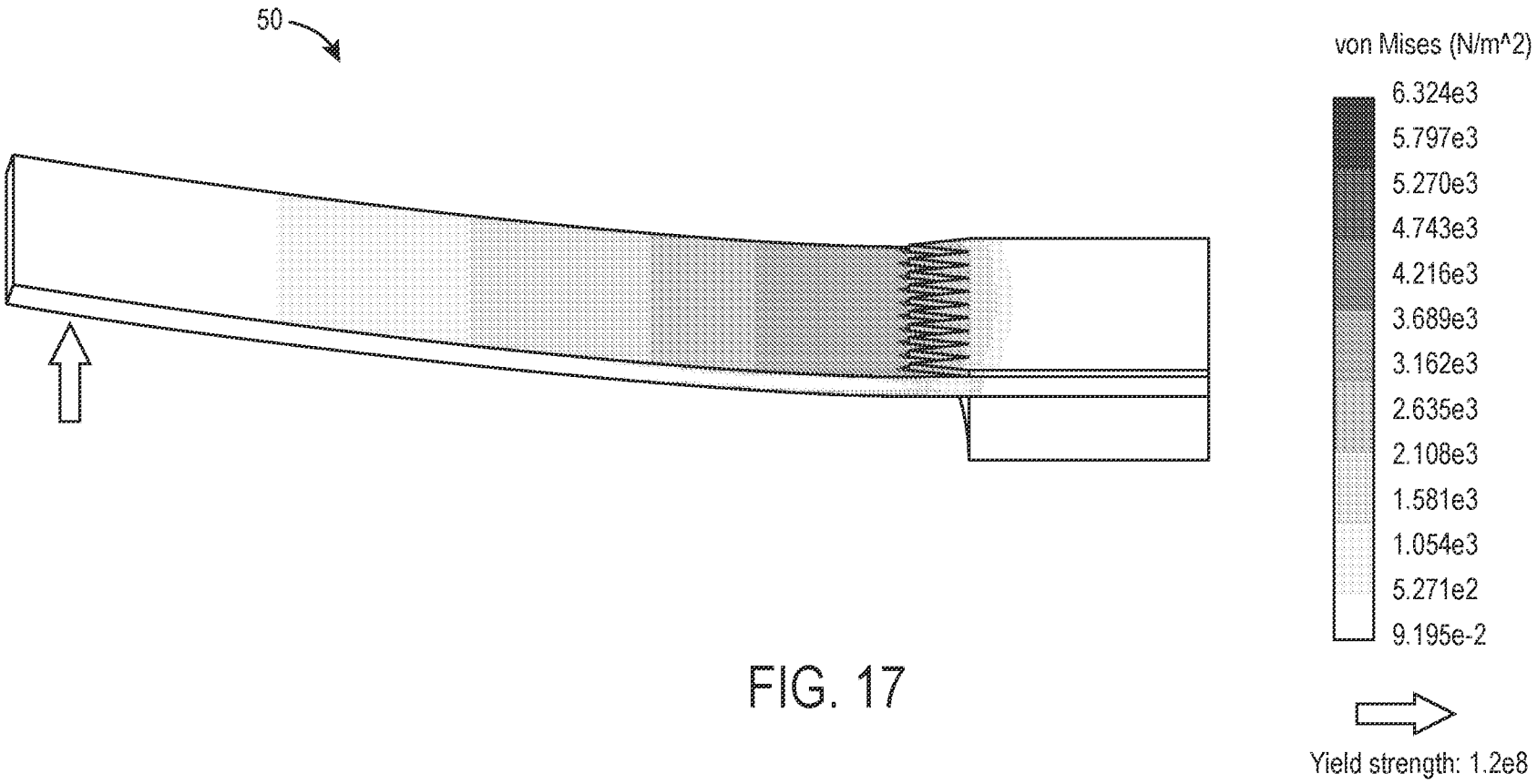
FIG. 17 is a contour plot showing the distribution of stress in a cantilevered beam supported by a stiffening member, according to an illustrative embodiment.
Figure 18:
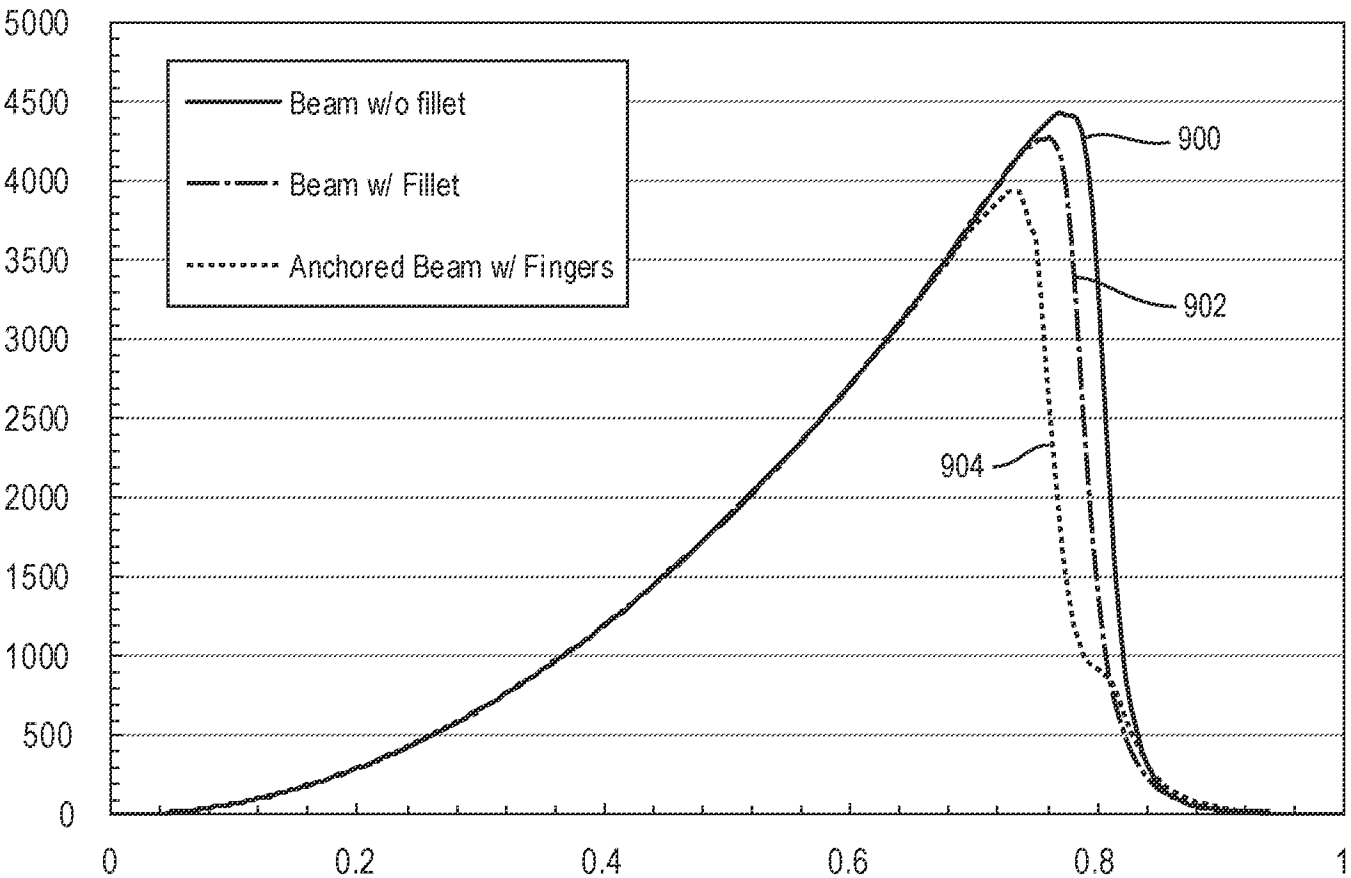
FIG. 18 is a graph showing stress as a function of position along the cantilevered beams of FIGS. 15-17, according to an illustrative embodiment.

FIGS. 15-18 illustrate the benefits provided by the stiffening members (e.g., beam 50 of FIG. 17) as compared with both simply supported diaphragms 52 (FIG. 15) and diaphragms supported by fillets 54 (FIG. 16). FIGS. 15-18 provide simulation results for each of the three different support configurations under uniform loading. In each simulation, a uniform pressure was applied to a first side of a cantilevered portion of the diaphragm. FIGS. 15, 16, and 17 provide contour plots illustrating the stress distribution in the diaphragm for each support configuration. FIG. 18 illustrates the stress distribution along a length of each diaphragm (e.g., from a second, free end of the beam to a first end of the beam). Line 900 (FIG. 18) shows the relationship between stress and position for the simply supported diaphragm 52. An anchor point for each beam (e.g., a perimeter of the aperture, a side wall of the substrate, etc.) is located at approximately 80% of the total distance from the second end to the first end. Line 902 (FIG. 18) shows the relationship between stress and position for the beam including fillets 54. Line 904 (FIG. 18) shows the relationship between stress and position for the diaphragm supported by a stiffening member.

As shown in FIG. 18, the stiffening member reduces the overall peak stress along the diaphragm for a given loading condition. The stiffening member also reduces the rate of change of stress proximate to the anchor point. Among other benefits, the reduction in peak stress increases the over-pressure and impact resistance of the MEMS structure.

The MEMS structure, of which various illustrative embodiments are disclosed herein, provides several advantages over simply supported diaphragms or beams as well as structures that utilize fillets near the perimeter of the anchor region to reduce peak stress under loading. The structure includes at least one stiffening member including a plurality of fingers that strengthen the diaphragm or beam. The fingers are configured to prevent a sharp transition in the stiffness of the diaphragm or beam near the perimeter of the anchor region. Among other benefits, the stiffening member may be formed from existing materials used in the fabrication of the MEMS structure, thereby reducing costs. Furthermore, by varying the dimensions and shape of the fingers, the over-pressure limits of the structure can be optimized for different applications.

The herein described subject matter sometimes illustrates different components contained within, or connected with, different other components. It is to be understood that such depicted architectures are illustrative, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation, no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general, such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B." Further, unless otherwise noted, the use of the words "approximate," "about," "around," "substantially," etc., mean plus or minus ten percent.

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. A MEMS transducer comprising:
- a transducer substrate defining an aperture;
- a diaphragm having a first side and a second side, the first side coupled to the transducer substrate and disposed over the aperture; and
- a first stiffening member coupled to the second side, the first stiffening member comprising:
- an anchoring region coupled to the second side around a perimeter of the aperture, and
  - a plurality of fingers extending radially inwards from the anchoring region beyond a perimeter of the aperture.

2. The MEMS transducer of claim 1, wherein the diaphragm is made from a dielectric material, wherein the transducer further comprises a second stiffening member coupled to the second side proximate to a central region of the second side, wherein the second stiffening member includes a second plurality of fingers extending outward toward a perimeter of the aperture, wherein the first and second stiffening members are spaced apart and are not in contact with one another, and wherein the second stiffening member is made from a conductive material.

3. The MEMS transducer of claim 2, wherein the first stiffening member is made from the same conductive material as the second stiffening member.

4. The MEMS transducer of claim 1, wherein the first stiffening member and the diaphragm are made from the same material.

5. The MEMS transducer of claim 1, wherein the fingers are triangular.

6. The MEMS transducer of claim 1, wherein the sides of each finger are curved outwards.

7. The MEMS transducer of claim 1, wherein the sides of each finger are curved inwards.

8. The MEMS transducer of claim 1, wherein a length of the fingers is greater than a thickness of the stiffening member.

9. The MEMS transducer of claim 1, wherein a width of the fingers is within a range between 25%-100% of a length of the fingers.

10. The MEMS transducer of claim 1, wherein a thickness of the first stiffening member is within a range between 50%-200% of a thickness of the diaphragm.

11. A microphone assembly comprising:
- a housing comprising a base, a cover, and a port, wherein the housing defines an enclosed volume;
- an acoustic transducer disposed in the enclosed volume, wherein the acoustic transducer comprises:
- a transducer substrate defining an aperture;
- a diaphragm having a first side and a second side, the first side coupled to the transducer substrate, wherein the diaphragm is in fluid communication with the port; and
- a first stiffening member coupled to the second side, the first stiffening member comprising:
  - an anchoring region coupled to the second side around a perimeter of the aperture, and
  - a plurality of fingers extending radially inwards from the anchoring region beyond a perimeter of the aperture.

12. The microphone assembly of claim 11, wherein the diaphragm is made from a dielectric material, wherein the transducer further comprises a second stiffening member coupled to the second side proximate to a central region of the second side, wherein the second stiffening member includes a second plurality of fingers extending outward toward the perimeter, wherein the first and second stiffening members are spaced apart and are not in contact with one another, and wherein the second stiffening member is made from a conductive material.

13. The microphone assembly of claim 12, wherein the first stiffening member is made of the same conductive material as the second stiffening member.

14. The microphone assembly of claim 11, wherein the first stiffening member and the diaphragm are made from the same material.

15. The microphone assembly of claim 11, wherein the fingers are triangular.

16. The microphone assembly of claim 11, wherein a length of one of the fingers is greater than a thickness of the stiffening member.

17. The microphone assembly of claim 11, wherein a width of the fingers is within a range between 25%-100% of a length of the fingers.

18. The microphone assembly of claim 11, wherein a thickness of the first stiffening member is within a range between 50%-200% of a thickness of the diaphragm.

19. The microphone assembly of claim 11, wherein the transducer substrate is coupled to the base, and wherein the aperture is substantially aligned with the port.

20. A MEMS acoustic transducer comprising:

a transducer substrate defining an aperture;

a diaphragm having a first side and a second side, the first side coupled to the transducer substrate and disposed over the aperture;

a back plate defining a plurality of openings, the back plate attached to the substrate, the back plate oriented substantially parallel to the diaphragm and offset from the diaphragm such that a cavity is formed therebetween; and a first stiffening member coupled to the second side of the diaphragm, the first stiffening member comprising:

an anchoring region coupled to the second side around a perimeter of the aperture, and a plurality of fingers extending radially inwards from the anchoring region beyond a perimeter of the aperture.

21. The MEMS acoustic transducer of claim 20, wherein the diaphragm is made from a dielectric material, wherein the transducer further comprises a second stiffening member coupled to the second side proximate to a central region of the second side, wherein the second stiffening member includes a second plurality of fingers extending outward toward the perimeter of the aperture, wherein the first and second stiffening members are spaced apart and are not in contact with one another, and wherein the second stiffening member is made from a conductive material.

22. The MEMS acoustic transducer of claim 20, wherein the fingers are substantially triangular.

23. The MEMS transducer of claim 20, wherein a length of the fingers is greater than a thickness of the first stiffening member.

24. The MEMS acoustic transducer of claim 20, wherein a width of the fingers is within a range between 25%-100% of a length of the fingers.

25. The MEMS acoustic transducer of claim 20, wherein a thickness of the first stiffening member is within a range between 50%-200% of a thickness of the diaphragm.

26. The MEMS acoustic transducer of claim 20, wherein the back plate comprises a conductive electrode proximate to a central region of the back plate, the conductive electrode comprising a third stiffening member having a third plurality of fingers extending outwards from the center of the conductive electrode.

27. The MEMS acoustic transducer of claim 26, wherein the back plate further comprises a fourth stiffening member having a plurality of fingers extending inwards from a perimeter of attachment between the back plate and the substrate.

28. A MEMS structure comprising:

a substrate defining a recessed region;

a MEMS element having a first side and a second side, the first side anchored to the substrate in an anchoring region, wherein at least a portion of the MEMS element is cantilevered over the recessed region; and a stiffening member coupled to the second side of the diaphragm, the stiffening member comprising:

an anchoring portion coupled to the second side over the anchoring region; and a plurality of fingers extending from the anchoring region over the recessed region.

* * * * *